US008753154B2

(12) United States Patent
Fujino et al.

(10) Patent No.: US 8,753,154 B2
(45) Date of Patent: Jun. 17, 2014

(54) WATERCRAFT

(75) Inventors: Kenichi Fujino, Shizuoka (JP); Yoshimasa Kinoshita, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 128 days.

(21) Appl. No.: 13/549,542

(22) Filed: Jul. 16, 2012

(65) Prior Publication Data

US 2013/0102206 A1 Apr. 25, 2013

(30) Foreign Application Priority Data

Oct. 19, 2011 (JP) ..... 2011-229466

(51) Int. Cl.
*B63H 21/22* (2006.01)

(52) U.S. Cl.
USPC ..... 440/1; 701/21

(58) Field of Classification Search
USPC ..... 440/1; 701/21, 116
See application file for complete search history.

(56) References Cited

U.S. PATENT DOCUMENTS 6,125,782 A 10/2000 Takashima et al.
7,755,472 B2 * 7/2010 Grossman ..... 340/426.1

FOREIGN PATENT DOCUMENTS

JP 11-043093 A 2/1999

* cited by examiner

*Primary Examiner* — Lars A Olson
(74) *Attorney, Agent, or Firm* — Keating & Bennett, LLP

(57) ABSTRACT

In a watercraft, a storage device stores area information including position information regarding a specified area. A controller compares a current position of a watercraft main body obtained by a global navigation satellite system receiver to the position information related to the specified area. The controller controls the watercraft main body in accordance with a normal mode when the current position of the watercraft main body is within the specified area. The controller controls the watercraft main body in accordance with a limited mode in which at least a portion of a plurality of functions of the watercraft main body are limited in comparison with the normal mode when the current position of the watercraft main body is not within the specified area.

19 Claims, 5 Drawing Sheets

WATERCRAFT

BACKGROUND OF THE INVENTION

1. Field of the Invention

The present invention relates to a watercraft including a global navigation satellite system (hereinafter referred to as "GNSS").

2. Description of the Related Art

In recent years, it has been proposed that a watercraft be provided with a receiver device for a GPS or other GNSS. For example, Laid-open Japanese Patent Application Publication 11-43093 discloses a small watercraft having a GPS antenna installed on a deck member.

Regulations regarding watercraft vary depending on the country and/or region. For example, regulations regarding the amount of harmful substances contained in exhaust gas do not exist in some countries or regions and amounts to which harmful emissions are restricted vary from country to country and region to region. Consequently, manufacturers manufacture watercrafts to different specifications depending on the destinations where they intend to sell the watercrafts and, in each country or region, they sell watercrafts manufactured to specifications compliant with the regulations of that particular country or region. However, once a watercraft has been introduced into the market, the watercraft is sometimes exported to a country or region other than the destination the manufacturer intended. In such a case, the watercraft ends up being used in a country or region having regulations with which the watercraft does not comply.

SUMMARY OF THE INVENTION

Preferred embodiments of the present invention prevent and suppress the occurrence of watercrafts being used in countries or regions having regulations with which the watercrafts do not comply.

A watercraft according to a preferred embodiment of the present invention includes a watercraft main body, a GNSS receiver, a storage device, and a controller. The GNSS receiver is installed on the watercraft main body and receives position information regarding the watercraft main body. The storage device stores area information including position information related to a specified area. The controller compares a current position of the watercraft main body obtained by the GNSS receiver to the position information related to the specified area. The controller controls the watercraft main body in accordance with a normal mode when the current position of the watercraft main body is within the specified area. The controller is configured to control the watercraft main body in accordance with a limited mode in which at least a portion of a plurality of functions of the watercraft main body are limited in comparison with the normal mode when the current position of the watercraft main body is not within the specified area.

With a watercraft according to the present preferred embodiment of the present invention, the watercraft main body is controlled in the normal mode when the watercraft main body is positioned within the specified area. Meanwhile, the watercraft is controlled in the limited mode when the watercraft is positioned outside the specified area. Thus, by storing area information in which a destination for which the watercraft is intended is provided as the specified area, at least a portion of the functions of the watercraft main body will be limited when the watercraft is used in an area outside the intended destination. In this way, the occurrence of watercrafts being used in countries or regions having regulations with which the watercrafts do not comply can be prenveted and suppressed.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A watercraft according to preferred embodiments of the present invention will now be explained with reference to the drawings.

Figure 1:
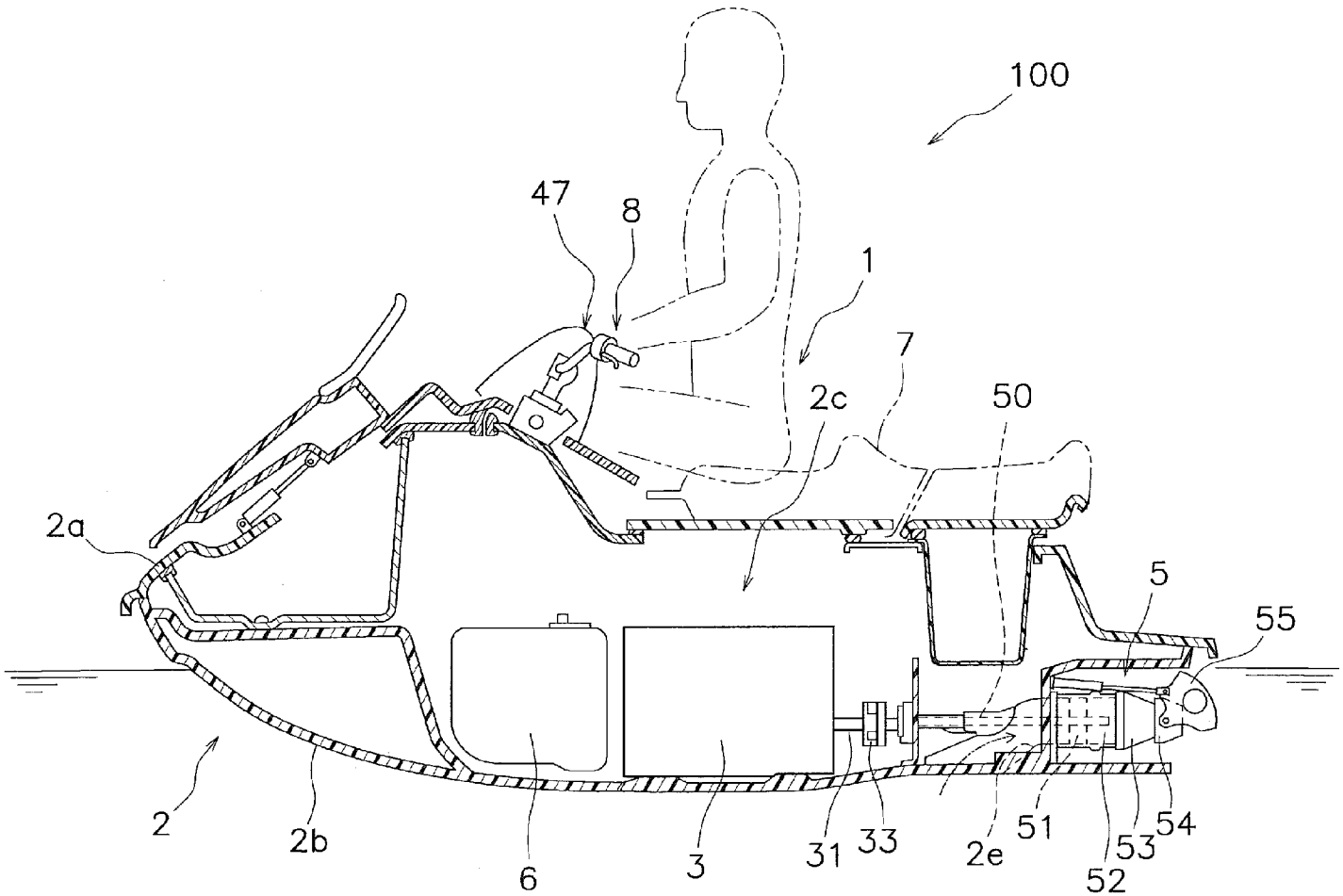
FIG. 1 is a sectional view showing an overall configuration of a watercraft according to a preferred embodiment of the present invention.
Figure 2:
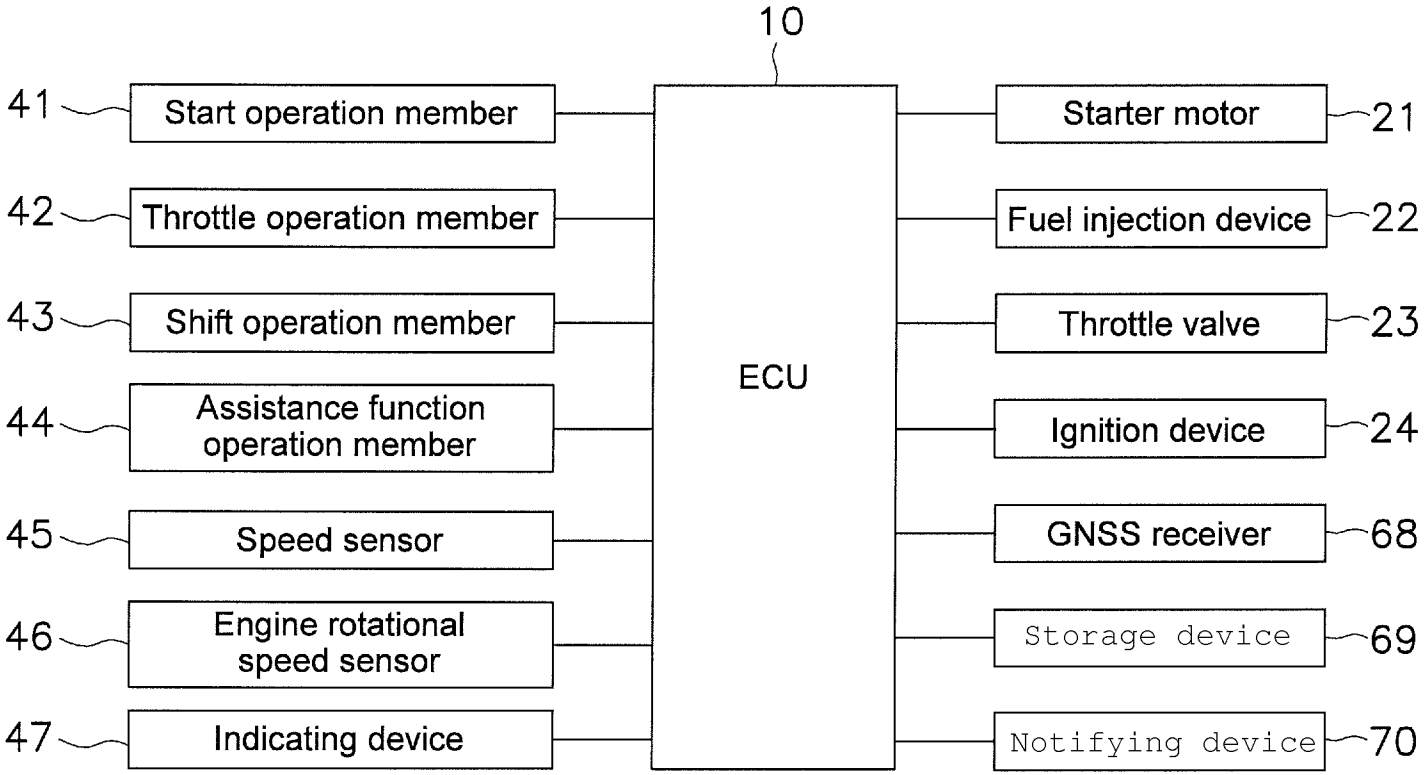
FIG. 2 is a block diagram showing a control system of the watercraft.

FIG. 1 is a sectional view showing an overall configuration of a watercraft 100 according to a preferred embodiment of the present invention. FIG. 2 is a block diagram showing a control system of the watercraft 100. The watercraft 100 preferably is a so-called personal watercraft (PWC), for example. The watercraft 100 includes a watercraft main body 1 shown in FIG. 1 and an ECU 10 (engine control unit) shown in FIG. 2.

As shown in FIG. 1, the watercraft main body 1 includes a hull body 2, an engine 3, and a jet propulsion unit 5. The hull body 2 includes a deck 2*a* and a hull 2*b*. An engine room 2*c* is provided inside the hull body 2. The engine 3 and a fuel tank 6 are housed inside the engine room 2*c*. A seat 7 is attached to the deck 2*a*. The seat 7 is arranged above the engine 3. A steering mechanism 8 that steers the hull body 2 is arranged in front of the seat 7.

The engine 3 preferably is, for example, an inline, four-cylinder, four-stroke engine. The engine 3 includes a crankshaft 31. The crankshaft 31 is arranged to extend in a longitudinal direction. As shown in FIG. 2, the watercraft main body 1 includes a starter motor 21, a fuel injection device 22, a throttle valve 23, and an ignition device 24. The starter motor 21 starts the engine 3. The fuel injection device 22 is configured to inject fuel into a combustion chamber of the engine 3. An amount of air-fuel mixture delivered to the combustion chamber is adjusted by varying an opening degree of the throttle valve 23. The ignition device 24 ignites fuel inside the combustion chamber. Although not depicted in FIG. 2, a fuel injection device 22 and an ignition device 24 are provided on each cylinder of the engine 3. In this preferred embodiment, a common throttle valve 23 is provided with respect to all of the cylinders of the engine 3. however, it is acceptable if a separate throttle valve 23 is provided with respect to each of the cylinders of the engine 3.

The jet propulsion device 5 is driven by the engine 3 and draws in water from around the hull body 2 and shoot the water out. As shown in FIG. 1, the jet propulsion unit 5 includes an impeller shaft 50, an impeller 51, an impeller housing 52, a nozzle 53, a deflector 54, and a reverse bucket 55. The impeller shaft 50 is arranged to extend rearward from the engine room 2*c*. A frontward portion of the impeller shaft 50 is coupled to the crankshaft 31 through a coupling portion 33. A rearward portion of the impeller shaft 50 passes through a water suction portion 2*e* of the hull body 2 and out through the inside of the impeller housing 52. The impeller housing 52 is connected to a rearward portion of the water suction portion 2*e*. The nozzle 53 is arranged rearward of the impeller housing 52.

The impeller 51 is attached to a rearward portion of the impeller shaft 50. The impeller 51 is arranged inside the impeller housing 52. The impeller 51 rotates together with the impeller shaft 50 and draws in water from the water suction portion 2*e*. The impeller 51 shoots the drawn water rearward from the nozzle 53. The deflector 54 is arranged rearward of the nozzle 53. The deflector 54 is configured to change a movement direction of water shot from the nozzle 53 to a leftward or a rightward direction. The reverse bucket 55 is arranged rearward of the deflector 54. The reverse bucket 55 is configured to change the movement direction of water shot from the nozzle 53 and diverted by the deflector 54 to a frontward direction.

As shown in FIG. 2, the watercraft main body includes such operating members as a start operation member 41, a throttle operation member 42, a shift operation member 43, and an assistance function operation member 44. The operating members are configured to be operated by an operator. The start operation member 41 is used to start the engine 3. The start operation member 41 is, for example, a start switch. The throttle operation member 42 is used to increase or decrease a rotational speed of the engine 3. The throttle operation member 42 increases and decreases the rotational speed of the engine 3 by varying an opening degree of the throttle valve 23. The throttle operation member 42 is, for example, a throttle lever. The shift operation member 43 changes between forward propulsion and reverse propulsion of the watercraft main body 1. The shift operation member 43 changes between forward propulsion and reverse propulsion of the watercraft main body 1 by varying a position of the reverse bucket 55. The shift operation member 43 is, for example, a shift lever. The assistance function operation member 44 is, for example, an operating member to change between execution and termination of an assistance function. Examples of an assistance function operation member 44 include a no-wake mode switch and a cruise control switch. The assistance function will be explained later.

The ECU 10 controls the engine 3. The ECU 10 is an example of a controller according to a preferred embodiment of the present invention. When the start operation member 41 is operated, the ECU 10 drives the starter motor 21 and the engine 3 starts. The watercraft main body 1 includes a speed sensor 45 and an engine speed sensor 46, as shown in FIG. 2., preferably as well as other sensors not shown in the figures, for example. The speed sensor 45 detects a speed of the watercraft main body 1. The engine speed sensor 46 detects a rotational speed of the engine 3. The other sensors include, for example, sensors to detect an external air temperature, a water temperature, and an oil temperature. The ECU 10 controls the engine 3 based on information detected by these sensors.

The ECU 10 executes an assistance function in response to an operation of the aforementioned operation members. Examples of an assistance function include a reverse control, a no-wake mode, and a cruise control. The reverse control is a control configured to control the engine 3 such that the rotational speed of the engine 3 does not exceed a prescribed rotational speed when the watercraft main body 1 is propelled in reverse by the reverse bucket 55. The ECU 10 executes the reverse control when the shift operation member 43 is arranged in a reverse propulsion position. The no-wake mode is a control configured to execute a low-speed travelling state while maintaining a predetermined engine rotational speed. The ECU 10 executes the no-wake mode when a no-wake mode switch is turned on. The cruise control is a control configured to hold the engine at a rotational speed that existed when an operating member (cruise control switch) was operated. The ECU 10 executes the cruise control when a cruise control switch is turned on.

Figure 3:
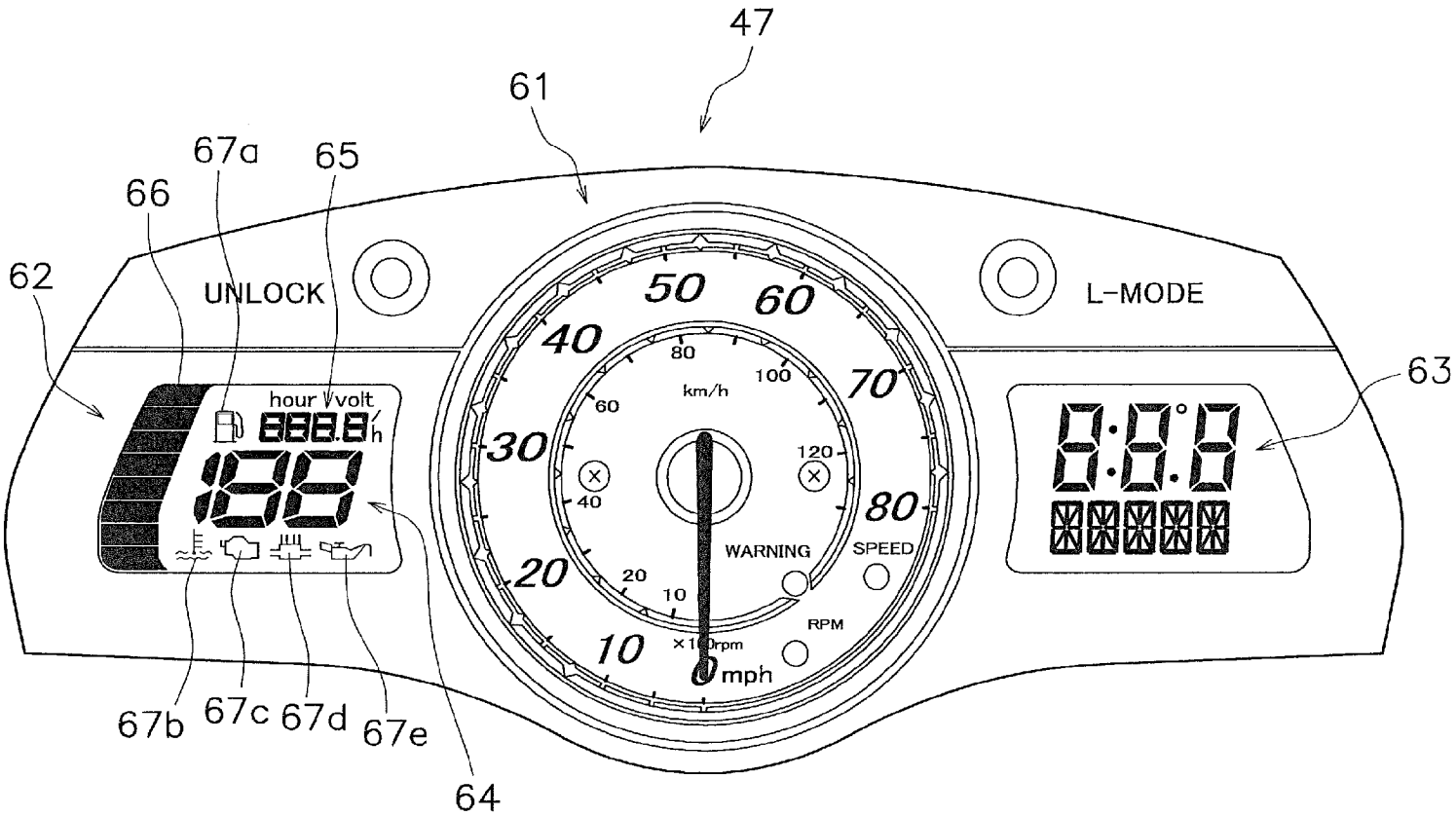
FIG. 3 shows an example of an indicator device.

As shown in FIG. 1 and FIG. 2, the watercraft main body 1 includes an indicating device 47. The indicating device 47 presents information related to the watercraft 100. The indicating device 47 preferably is, for example, a liquid crystal monitor. FIG. 3 is an example of an indicating device 47. In FIG. 3, the indicating device 47 is depicted indicating all of the content that can be indicated simultaneously. The indicating device 47 includes a first indicating portion 61, a second indicating portion 62, and a third indicating portion 63. The first indicating portion 61 indicates a speed of the watercraft main body 1 and a rotational speed of the engine 3. More specifically, the first indicating portion 61 switches between displaying an analog speedometer and an analog tachometer.

The second indicating portion 62 includes a digital speedometer 64 and an hour/voltage indicating portion 65. The digital speedometer 64 indicates a speed of the watercraft main body 1 in a digital format. When one of the aforementioned assistance functions is executed, the digital speedometer 64 indicates the speed in a flashing manner to inform an operator that the assistance function is being executed. The hour/voltage indicating portion 65 switches between indication of a cumulative operating time of the engine 3 and a voltage of a battery. The second indicating portion 62 also displays a fuel gauge 66 and a variety of warning lamps 67*a* to 67*e*. The fuel gauge 66 indicates an amount of fuel remaining. The warning lamps 67*a* to 67*e* include a remaining fuel amount warning 67*a*, an overheat warning 67*b*, a check engine warning 67*c*, a catalytic converter warning 67*d*, and an oil warning 67*e*. The remaining fuel amount warning 67*a* illuminates when the amount of fuel remaining is low. The overhead warning illuminates when an engine temperature has become excessively high. The check engine warning 67*c* illuminates when a sensor failure, a severed sensor connection, or other abnormality is detected. The catalytic converter warning 67*d* illuminates when a temperature of a catalytic converter (not shown) serving to clean an exhaust gas discharged from the engine 3 has become excessively high. The oil warning 67*e* illuminates when a pressure of an engine oil has become excessively low.

The third indicating portion 63 is configured to selectively indicate a variety of information regarding the watercraft main body 1. Specifically, the third indicating portion 63 is configured to switch between states of displaying, for example, an average speed, an elapsed time, and a traveled distance. The third indicating portion 63 also indicates a direction in which the watercraft main body 1 is moving. More specifically, the third indicating portion 63 displays such words as "NORTH," "EAST," "SOUTH," "WEST," "N-EAST," "S-EAST," "N-WEST," and "S-WEST." The third indicating portion also indicates such information as an external air temperature, a water temperature, and a fuel consumption rate.

Figure 4:
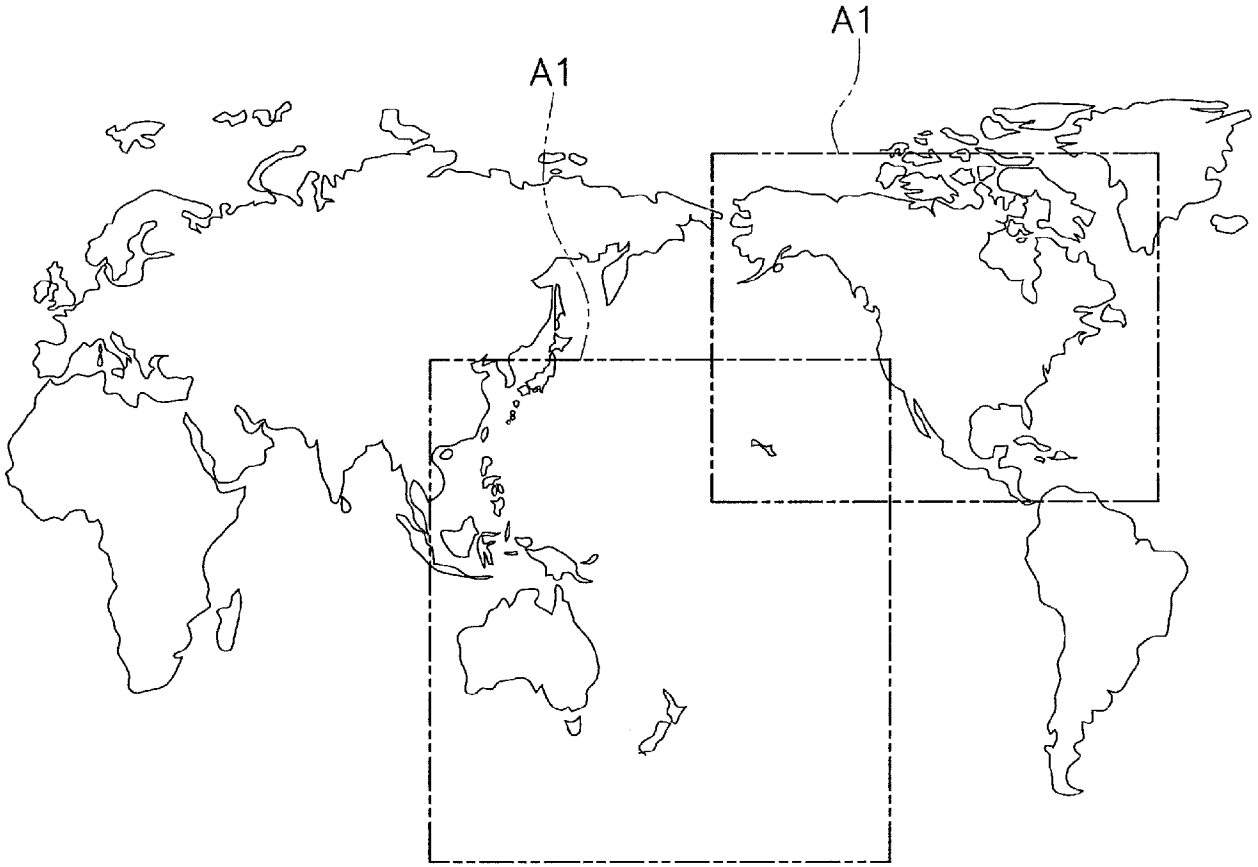
FIG. 4 shows an example of area information.

As shown in FIG. 2, the watercraft main body 1 includes a GNSS receiver 68 and a storage device 69. The GNSS receiver 68 receives position information related to the watercraft main body 1. The storage device 69 is configured to store area information including position information related to a specified area. More specifically, the area information includes a GNSS coordinate system indicating a specified area. For example, as shown in FIG. 4, a specified area A1 is a destination for which the watercraft 100 is intended. In other words, the specified area A1 is a sales region where the watercraft 100 is scheduled to be used. The ECU 10 is configured to compare a current position of the watercraft main body 1 obtained by the GNSS receiver 68 to the position information of the specified area A1. The ECU 10 controls the watercraft main body 1 in accordance with a normal mode when the current position of the watercraft main body 1 is within the specified area A1. The ECU 10 controls the watercraft main body 1 in accordance with a limited mode when the current position of the watercraft main body 1 is not within the specified area A1. In the limited mode, the ECU 10 limits at least a portion of the functions of the watercraft main body in comparison with the normal mode. At least one of the function limitations (1) to (4) explained below is imposed during the limited mode. It is also acceptable if all of the function limitations (1) to (4) are imposed or if a combination of a portion of the function limitations (1) to (4) is imposed.

(1) Prohibition of Starting the Engine 3

In the limited mode, the ECU 10 prohibits starting the engine 3. The start prohibition of the engine 3 is accomplished by, for example, not driving the starter motor 21. The start prohibition of the engine 3 can also be accomplished by stopping the fuel injection device 22 from injecting fuel. The start prohibition of the engine 3 can also be accomplished by limiting an amount of fuel injected by the fuel injection device 22 to an amount that is too small to enable the engine 3 to be started. The start prohibition of the engine 3 can also be accomplished by stopping the ignition device 24 from igniting. The start prohibition of the engine 3 can also be accomplished by limiting a throttle opening degree of the throttle valve 23 to an opening degree that is too small to enable the engine 3 to be started.

(2) Limitation of an Assistance Function

Although the assistance functions explained previously can be used in the normal mode, the ECU 10 limits the actuation of assistance functions in the limited mode. For example, in the limited mode, the ECU 10 does not start the cruise control even if the cruise control switch is depressed. Or, in the limited mode, the ECU 10 does not execute reverse control even if the shift operation member 43 is arranged in the reverse propulsion position. Or, in the limited mode, the ECU 10 does not start the no-wake mode even if the no-wake mode switch is depressed.

(3) Limitation of Engine Performance

In the limited mode, the ECU 10 limits the rotational speed of the engine 3 such that the rotational speed of the engine 3 does not exceed a prescribed rotational speed. The limitation of the rotational speed of the engine 3 is accomplished by, for example, not allowing the amount of fuel injected by the fuel injection device 22 to exceed a prescribed amount. The limitation of the rotational speed of the engine 3 can also be accomplished by offsetting an ignition timing at which the ignition device 24 executes ignition from an ignition timing used in the normal mode. The limitation of the rotational speed of the engine 3 can be accomplished by limiting a number of times the ignition device 24 ignites. That is, the limitation of the rotational speed of the engine 3 can be accomplished by reducing a number spark ignitions executed by the ignition device 24 to a smaller number than is executed in the normal mode. Furthermore, the limitation of the number of ignitions can be accomplished by not executing an ignition at any of one or more cylinders or by reducing the number ignitions executed at any of one or more cylinders. The limitation of the rotational speed of the engine 3 can also be accomplished by not allowing the opening degree of the throttle valve 23 to exceed a prescribed opening degree.

In the limited mode, it is also acceptable if the ECU 10 limits a speed of the watercraft 100 such that the speed does not exceed a prescribed speed. The limitation of the speed of the watercraft 100 is accomplished by, for example, not allowing the amount of fuel injected by the fuel injection device 22 to exceed a prescribed amount. The limitation of the speed of the watercraft 100 can also be accomplished by offsetting an ignition timing at which the ignition device 24 ignites from an ignition timing used in the normal mode. The limitation of the speed of the watercraft 100 can also be accomplished by limiting a number of times the ignition device 24 ignites. The limitation of the speed of the watercraft 100 can also be accomplished by not allowing the opening degree of the throttle valve 23 to exceed a prescribed opening degree.

(4) Limitation of Content Indicated on the Indicating Device 47

In the limited mode, the ECU 10 does not display at least a portion of the items displayed on the indicating device 47 during the normal mode. Examples of items not displayed during the limited mode include the analog speedometer and the analog tachometer of the first indicating portion 61 and the digital speedometer 64 of the second indicating portion 62. It is also acceptable for the items not displayed during the limited mode to be the indicators serving to inform an operator that an assistance function is being executed. In such a case, during the limited mode, the digital speedometer 64 will not flash even if the assistance function is being executed. It is also acceptable for the items not displayed during the limited mode to be the information displayed on the third indicating portion 63. In such a case, during the limited mode, an average speed, an elapsed time, a traveled distance, a direction of the watercraft main body 1, an external air temperature, a water temperature, a fuel consumption rate, etc., are not indicated on the third indicating portion 63.

The ECU 10 is configured to display warning indications warning of abnormalities of the watercraft main body 1 even if the limited mode is in effect. Thus, even in the limited mode, the warning lamps 67*a* to 67*e* are displayed when an abnormality occurs in the watercraft 100.

The ECU 10 is configured to compare a current position of the watercraft main body 1 obtained by the GNSS receiver 68 to the position information of the specified area A1 when the start operation member 41 is operated. The ECU 10 then determines whether to control the watercraft main body 1 in the normal mode or the limited mode. While the watercraft main body 1 is being operated, the ECU 10 maintains the current operating mode, i.e., does not change the control mode, even if the current position of the watercraft main body 1 changes from a position inside the specified area A1 to a position outside the specified area A1 or from a position outside the specified area A1 to a position inside the specified area A1.

As shown in FIG. 2, the watercraft main body 1 includes a notifying device 70 to urge caution to an operator. In the limited mode, the ECU 10 controls the notifying device 70 to notify an operator that the current position of the watercraft main body 1 is outside the specified area A1. The notifying device 70 is configured to emit a sound to urge caution to an operator. In the limited mode, the ECU 10 is controls the notifying device 70 to constantly emit the sound. The constant sound emission mentioned here does not exclude a buzzer sound or other sound emitted intermittently, for example. It is also acceptable if the notifying device 70 is configured to display a warning indication on the indicating device 47 instead of emitting a sound. It is also acceptable if the notifying device is configured to both emit a sound notification and display a warning indication.

A watercraft 100 according to this preferred embodiment is controlled in the normal mode when the watercraft 100 is positioned inside the specified area A1. Meanwhile, the watercraft 100 is controlled in the limited mode when the watercraft 100 is positioned outside the specified area A1. Thus, when the watercraft 100 is used in an area other than an intended destination, at least a portion of the functions of the watercraft 100 are limited. In this way, use of the watercraft 100 in countries or regions having regulations with which the watercraft does not comply is suppressed and prevented.

Although a preferred embodiment of the present invention has been described above, the present invention is not limited to the preferred embodiment described above. Various changes can be made without departing from the scope of the present invention.

Although the watercraft 100 presented in the preceding preferred embodiment preferably is a personal watercraft, it is acceptable for a watercraft according to various preferred embodiments of the present invention to be a sport boat. A watercraft according to various preferred embodiments of the present invention is preferably a small watercraft, such as a water jet propulsion watercraft, for example. The indicating device is not limited to a liquid crystal monitor and it is acceptable for the indicating device to be a device configured to present information using another method. The displayed items and layout of the indicating device are not limited to the displayed items and layout of the previously explained indicating device 47 and it is acceptable for them to be changed.

In the previously explained preferred embodiment, the ECU 10 is configured to compare a current position of the watercraft main body 1 obtained by the GNSS receiver 68 to the position information of the specified area A1 when the start operation member 41 is operated. However, it is acceptable for the ECU 10 to continuously execute a determination of whether to control the watercraft main body 1 in the normal mode or the limited mode while the watercraft main body 1 is being operated. In such a case, while the watercraft main body 1 is being operated, the ECU 10 changes the current operating mode if the current position of the watercraft main body 1 changes from a position inside the specified area A1 to a position outside the specified area A1 or from a position outside the specified area A1 to a position inside the specified area A1.

Figure 5A:
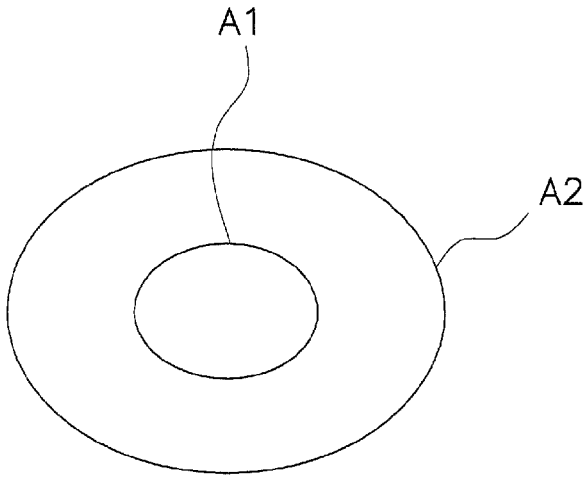
FIGS. 5A and 5B illustrate an example of area information in accordance with another preferred embodiment of the present invention.

It is acceptable if, as shown in FIG. 5A, the area information includes position information related to a secondary specified area A2 that is different from the specified area A1. In such a case, the ECU 10 controls the watercraft main body 1 in accordance with a first limited mode when the current position of the watercraft main body 1 is within the secondary specified area A2. In the first limited mode, at least a portion of the functions of the watercraft main body 1 are limited in comparison with the normal mode. Meanwhile, the ECU 10 controls the watercraft main body 1 in accordance with a second limited mode when the current position of the watercraft main body 1 is within neither the specified area A1 nor the secondary specified area A2. In the second limited mode, the functions of the watercraft main body 1 are limited even more than in the first limited mode. For example, the number of limited items is larger in the second limited mode than in the first limited mode. It is also acceptable if a degree of limitation is larger in the second limited mode than in the first limited mode. More specifically, the limitation could be strengthened in stages as the watercraft main body 1 moves farther away from the specified area A1, i.e., the intended destination. For example, it is acceptable that the limitation is set such that the aforementioned assistance functions are limited in the first limited mode and starting the engine is prohibited in the second limited mode. It is also acceptable that the limitation is set such that the rotational speed of the engine 3 is limited in the first limited mode and starting the engine is prohibited in the second limited mode.

Figure 5B:
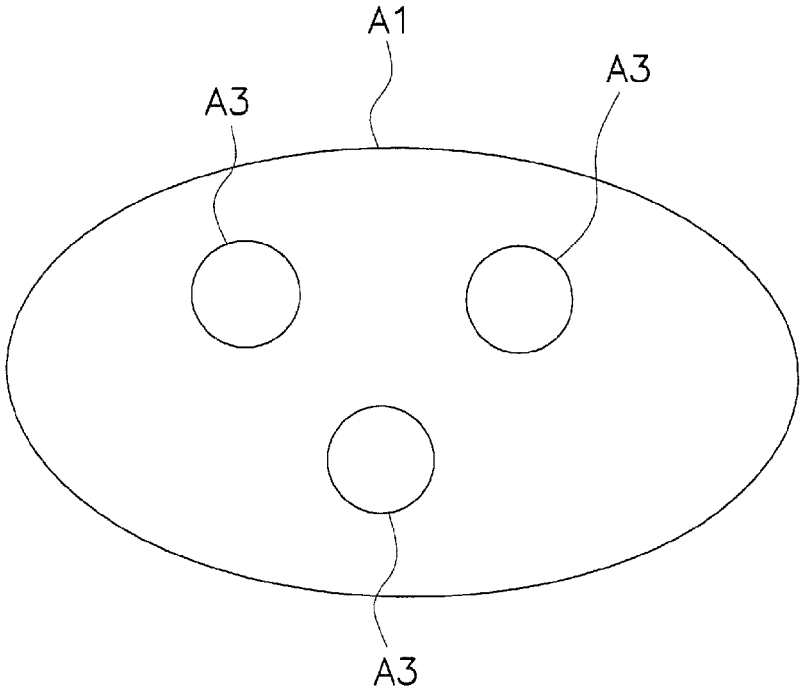

It is acceptable if, as shown in FIG. 5B, the area information includes position information related to a limited speed area A3 that is contained in the specified area A1. In such a case, the ECU 10 controls the engine 3 such that a speed of the watercraft main body 1 does not exceed a prescribed speed limit when the current position of the watercraft main body 1 is within the limited speed area A3. It is also acceptable if the ECU 10 controls the engine 3 such that the rotational speed of engine does not exceed a prescribed rotational speed limit when the current position of the watercraft main body 1 is within the limited speed area A3. Additionally, it is also acceptable if a plurality of limited speed areas A3 are contained within the specified area A1 shown in FIG. 5A.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft comprising:

a watercraft main body;

a global navigation satellite system receiver installed on the watercraft main body to receive position information regarding the watercraft main body;

a storage device that stores area information including position information regarding a specified area; and a controller programmed to compare a current position of the watercraft main body obtained by the global navigation satellite system receiver to the position information regarding the specified area, control the watercraft main body in accordance with a normal mode when the current position of the watercraft main body is within the specified area, and control the watercraft main body in accordance with a limited mode in which at least a portion of a plurality of functions of the watercraft main body are limited in comparison with the normal mode when the current position of the watercraft main body is not within the specified area; wherein the watercraft main body includes an engine and the controller prohibits starting of the engine during the limited mode; and the watercraft main body includes a fuel injection device that supplies fuel to the engine and the controller does not execute fuel injection by the fuel injection device during the limited mode.

2. A watercraft comprising:

a watercraft main body;

a global navigation satellite system receiver installed on the watercraft main body to receive position information regarding the watercraft main body;

a storage device that stores area information including position information regarding a specified area; and a controller programmed to compare a current position of the watercraft main body obtained by the global navigation satellite system receiver to the position information regarding the specified area, control the watercraft main body in accordance with a normal mode when the current position of the watercraft main body is within the specified area, and control the watercraft main body in accordance with a limited mode in which at least a portion of a plurality of functions of the watercraft main body are limited in comparison with the normal mode when the current position of the watercraft main body is not within the specified area; wherein the watercraft main body includes an engine and the controller prohibits starting of the engine during the limited mode; and the watercraft main body includes a fuel injection device that supplies fuel to the engine and the controller limits an amount of fuel injected by the fuel injection device to an amount at which the engine cannot start during the limited mode.

3. A watercraft comprising:

a watercraft main body;

a global navigation satellite system receiver installed on the watercraft main body to receive position information regarding the watercraft main body;

a storage device that stores area information including position information regarding a specified area; and a controller programmed to compare a current position of the watercraft main body obtained by the global navigation satellite system receiver to the position information regarding the specified area, control the watercraft main body in accordance with a normal mode when the current position of the watercraft main body is within the specified area, and control the watercraft main body in accordance with a limited mode in which at least a portion of a plurality of functions of the watercraft main body are limited in comparison with the normal mode when the current position of the watercraft main body is not within the specified area; wherein the watercraft main body includes an engine and the controller prohibits starting of the engine during the limited mode; and the watercraft main body includes a throttle valve that adjusts an amount of air supplied to the engine and the controller limits an opening degree of the throttle valve to an opening degree at which the engine cannot start during the limited mode.

4. A watercraft comprising:

a watercraft main body;

a global navigation satellite system receiver installed on the watercraft main body to receive position information regarding the watercraft main body;

a storage device that stores area information including position information regarding a specified area; and a controller programmed to compare a current position of the watercraft main body obtained by the global navigation satellite system receiver to the position information regarding the specified area, control the watercraft main body in accordance with a normal mode when the current position of the watercraft main body is within the specified area, and control the watercraft main body in accordance with a limited mode in which at least a portion of a plurality of functions of the watercraft main body are limited in comparison with the normal mode when the current position of the watercraft main body is not within the specified area; wherein the watercraft main body includes an engine and an operating member to be operated by an operator;

the controller controls the engine such that a prescribed assistance function is started in response to an operation of the operating member when the operating member is operated during the normal mode; and the controller prevents execution of the prescribed assistance function during the limited mode.

5. The watercraft according to claim 4, wherein the prescribed assistance function is a cruise control that maintains a rotational speed of the engine at a rotational speed occurring at a point in time when the operating member was operated, and the controller does not start the cruise control during the limited mode.

6. The watercraft according to claim 4, wherein the watercraft main body includes a water jet propulsion device that is driven by the engine and a reverse bucket that changes a direction in which water from the water jet propulsion device is ejected;

the prescribed assistance function is a reverse control that controls the engine such that a rotational speed of the engine does not exceed a prescribed rotational speed when the watercraft main body is propelled in reverse by the reverse bucket;

the controller does not execute the reverse control during the limited mode.

7. A watercraft comprising:

a watercraft main body;

a global navigation satellite system receiver installed on the watercraft main body to receive position information regarding the watercraft main body;

a storage device that stores area information including position information regarding a specified area; and a controller programmed to compare a current position of the watercraft main body obtained by the global navigation satellite system receiver to the position information regarding the specified area, control the watercraft main body in accordance with a normal mode when the current position of the watercraft main body is within the specified area, and control the watercraft main body in accordance with a limited mode in which at least a portion of a plurality of functions of the watercraft main body are limited in comparison with the normal mode when the current position of the watercraft main body is not within the specified area; wherein the watercraft main body includes an engine and the controller limits a rotational speed of the engine such that the rotational speed does not exceed a prescribed rotational speed during the limited mode.

8. The watercraft according to claim 7, wherein the watercraft main body includes a fuel injection device that supplies fuel to the engine and the controller executes a control such that an amount of fuel injected by the fuel injection device does not exceed a prescribed amount during the limited mode.

9. The watercraft according to claim 7, wherein the watercraft main body includes an ignition device that ignites fuel in the engine, and during the limited mode, the controller executes a control such that an ignition timing at which the ignition device executes ignition is offset from an ignition timing used during the normal mode.

10. The watercraft according to claim 7, wherein the watercraft main body includes an ignition device that ignites fuel in the engine and the controller limits a number of times ignition is executed by the ignition device during the limited mode.

11. The watercraft according to claim 7, wherein the watercraft main body includes a throttle valve that adjusts an amount of air supplied to the engine and the controller executes a control such that an opening degree of the throttle valve does not exceed a prescribed opening degree during the limited mode.

12. A watercraft comprising:

a watercraft main body;

a global navigation satellite system receiver installed on the watercraft main body to receive position information regarding the watercraft main body;

a storage device that stores area information including position information regarding a specified area; and a controller programmed to compare a current position of the watercraft main body obtained by the global navigation satellite system receiver to the position information regarding the specified area, control the watercraft main body in accordance with a normal mode when the current position of the watercraft main body is within the specified area, and control the watercraft main body in accordance with a limited mode in which at least a portion of a plurality of functions of the watercraft main body are limited in comparison with the normal mode when the current position of the watercraft main body is not within the specified area; wherein the watercraft main body includes an engine and the controller controls the engine such that a speed of the watercraft does not exceed a prescribed speed during the limited mode.

13. The watercraft according to claim 12, wherein the watercraft main body includes a fuel injection device that supplies fuel to the engine and the controller executes a control such that an amount of fuel injected by the fuel injection device does not exceed a prescribed amount during the limited mode.

14. The watercraft according to claim 12, wherein the watercraft main body includes an ignition device that ignites fuel in the engine, and during the limited mode, the controller executes a control such that an ignition timing at which the ignition device executes ignition is offset from an ignition timing used during the normal mode.

15. The watercraft according to claim 12, wherein the watercraft main body includes an ignition device that ignites fuel in the engine and the controller limits a number of times ignition is executed by the ignition device during the limited mode.

16. The watercraft according to claim 12, wherein the watercraft main body includes a throttle valve that adjusts an amount of air supplied to the engine and the controller executes a control such that an opening degree of the throttle valve does not exceed a prescribed opening degree during the limited mode.

17. A watercraft comprising:

a watercraft main body;

a global navigation satellite system receiver installed on the watercraft main body to receive position information regarding the watercraft main body;

a storage device that stores area information including position information regarding a specified area; and a controller programmed to compare a current position of the watercraft main body obtained by the global navigation satellite system receiver to the position information regarding the specified area, control the watercraft main body in accordance with a normal mode when the current position of the watercraft main body is within the specified area, and control the watercraft main body in accordance with a limited mode in which at least a portion of a plurality of functions of the watercraft main body are limited in comparison with the normal mode when the current position of the watercraft main body is not within the specified area; wherein the watercraft main body includes an engine and a start operation member that starts the engine;

when the start operation member is operated, the controller determines whether to control the watercraft main body in the normal mode or the limited mode; and while the watercraft main body is being operated, the controller does not change the control mode even if the current position of the watercraft main body changes from a position inside the specified area to a position outside the specified area or from a position outside the specified area to a position inside the specified area.

18. A watercraft comprising:

a watercraft main body;

a global navigation satellite system receiver installed on the watercraft main body to receive position information regarding the watercraft main body;

a storage device that stores area information including position information regarding a specified area; and a controller programmed to compare a current position of the watercraft main body obtained by the global navigation satellite system receiver to the position information regarding the specified area, control the watercraft main body in accordance with a normal mode when the current position of the watercraft main body is within the specified area, and control the watercraft main body in accordance with a limited mode in which at least a portion of a plurality of functions of the watercraft main body are limited in comparison with the normal mode when the current position of the watercraft main body is not within the specified area; wherein the area information further includes position information regarding a secondary specified area different from the specified area;

the controller controls the watercraft main body in accordance with a first limited mode in which at least a portion of the functions of the watercraft main body are limited in comparison with the normal mode when a current position of the watercraft main body is within the secondary specified area; and the controller controls the watercraft main body in accordance with a second limited mode in which the functions of the watercraft main body are limited even more than in the first limited mode when a current position of the watercraft main body is not within the specified area or the secondary specified area.

19. A watercraft comprising:

a watercraft main body;

a global navigation satellite system receiver installed on the watercraft main body to receive position information regarding the watercraft main body;

a storage device that stores area information including position information regarding a specified area; and a controller programmed to compare a current position of the watercraft main body obtained by the global navigation satellite system receiver to the position information regarding the specified area, control the watercraft main body in accordance with a normal mode when the current position of the watercraft main body is within the specified area, and control the watercraft main body in accordance with a limited mode in which at least a portion of a plurality of functions of the watercraft main body are limited in comparison with the normal mode when the current position of the watercraft main body is not within the specified area; wherein the watercraft main body includes an engine; and the area information further includes position information regarding a limited speed area contained within the specified area; and the controller controls the engine such that a speed of the watercraft main body does not exceed a prescribed speed limit or such that a rotational speed of the engine does not exceed a prescribed rotational speed limit when a current position of the watercraft main body is within the limited speed area.

* * * * *